US008245546B2

(12) United States Patent
Olsson

(10) Patent No.: US 8,245,546 B2
(45) Date of Patent: Aug. 21, 2012

(54) CONTAINER LOCK AND METHOD FOR LOCKING OF CONTAINER DOOR

(75) Inventor: Nils Olsson, Fjärås (SE)

(73) Assignee: Nils Olsson, Fjaras (SE)

( * ) Notice: Subject to any disclaimer, the term of this patent is extended or adjusted under 35 U.S.C. 154(b) by 734 days.

(21) Appl. No.: 12/226,228

(22) PCT Filed: Mar. 29, 2007

(86) PCT No.: PCT/EP2007/002786

§ 371 (c)(1),
(2), (4) Date: Mar. 31, 2009

(87) PCT Pub. No.: WO2007/118586

PCT Pub. Date: Oct. 25, 2007

(65) Prior Publication Data

US 2009/0242563 A1 Oct. 1, 2009

(30) Foreign Application Priority Data

Apr. 13, 2006 (EP) ..... 06112631

(51) Int. Cl.
*E05B 65/06* (2006.01)

(52) U.S. Cl. ..... 70/14; 70/54; 70/55; 70/56; 70/94; 70/101; 292/1; 292/288; 292/289; 292/346

(58) Field of Classification Search ..... 70/94, 101, 70/54–56, 14, DIG. 64, DIG. 65, DIG. 66; 292/1, 288, 289, 346, DIG. 29, DIG. 53, 292/DIG. 54, DIG. 51, DIG. 64
See application file for complete search history.

(56) References Cited

U.S. PATENT DOCUMENTS

| | | | | |
|---|---|---|---|---|
| 3,504,405 | A * | 4/1970 | Elliott-Smith | 70/58 |
| 3,570,283 | A * | 3/1971 | Males | 70/14 |
| 3,572,062 | A | 3/1971 | Beebe | |
| 3,926,018 | A * | 12/1975 | Joersz | 70/19 |
| 4,119,239 | A | 10/1978 | Anderson | |
| 4,326,394 | A * | 4/1982 | Stein | 70/14 |
| 4,372,136 | A * | 2/1983 | Mickelson | 70/14 |

(Continued)

OTHER PUBLICATIONS

International Search Report.

(Continued)

*Primary Examiner* — Lloyd Gall
*Assistant Examiner* — Ifeolu Adeboyejo
(74) *Attorney, Agent, or Firm* — Harness, Dickey & Pierce, P.L.C.

(57) ABSTRACT

The present invention relates to a container lock, a method for locking a container with at least one door (2), and a container provided with a lock, said door (2) having a first frame edge portion (4), and said container having a second frame edge portion (5) positioned adjacent to said first frame edge portion (4) in a closed position of the door, wherein said container lock comprises: an interior blocking portion (6), having a body (20) adapted to extend over said first and second frame edge portions (4, 5), and an engaging abutment (7, 47, 87, 107) and an extension portion (8, 88, 108) extending out from said body (20) so that, when said interior portion (6) is arranged on the inside of said second frame edge portion (5), said engaging abutment (7, 47, 87, 107) and extension portion (8, 88, 108) provide interacting engagement of opposite side surfaces of said second frame edge portion (5), and said extension portion (8, 88, 108) extends from the interior of the container to the exterior of the container, and an exterior blocking means (9) for lockable interaction with said extension portion (8, 88, 108).

21 Claims, 9 Drawing Sheets

U.S. PATENT DOCUMENTS

| | | | | |
|---|---|---|---|---|
| 4,566,296 | A | 1/1986 | Kochakis | |
| 4,852,920 | A * | 8/1989 | DeForrest, Sr. | 292/205 |
| 5,035,127 | A | 7/1991 | Larsen | |
| 5,076,078 | A | 12/1991 | Weger, Jr. | |
| 5,145,222 | A * | 9/1992 | Meyer | 292/258 |
| D439,826 | S * | 4/2001 | Oddy | D8/336 |
| 6,553,797 | B2 * | 4/2003 | Witchey | 70/209 |
| 6,622,533 | B1 | 9/2003 | Santini | |
| D481,614 | S * | 11/2003 | Onel | D8/331 |
| 6,834,896 | B2 * | 12/2004 | Smith | 292/259 R |
| 7,272,963 | B2 * | 9/2007 | Rosenberg et al. | 70/126 |
| 7,278,663 | B2 * | 10/2007 | Witchey | 292/259 R |
| 7,775,253 | B1 * | 8/2010 | Milligan | 160/117 |
| 2005/0099018 | A1 | 5/2005 | Witchey | |

OTHER PUBLICATIONS

Bengt Royne Bengtsson, "Office for Harmonization in the Internal Market (Trademarks and Designs)," Certificate of Registration No. 000415427, dated Nov. 15, 2005.

* cited by examiner

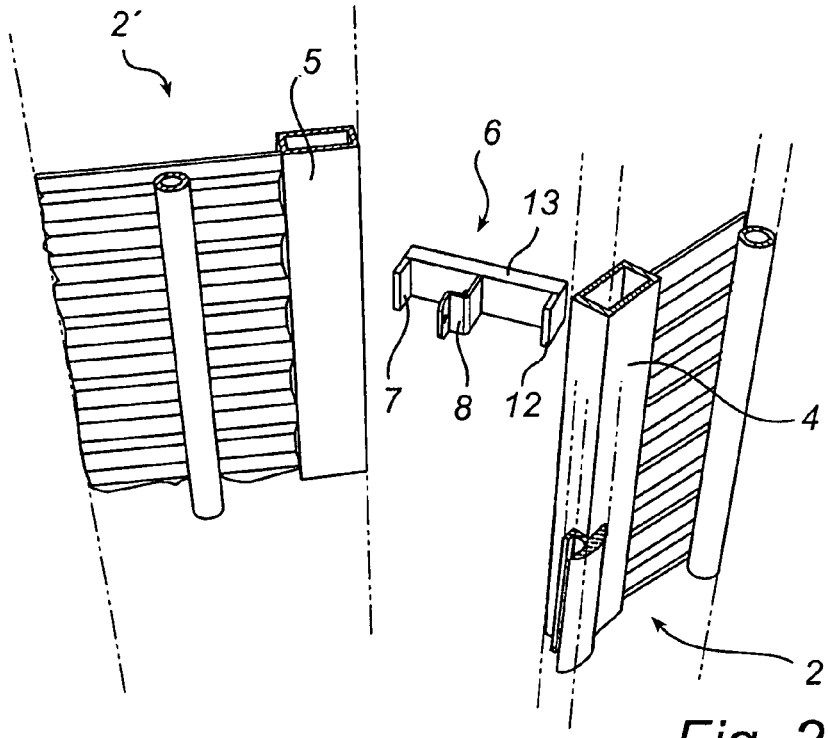
Fig. 2
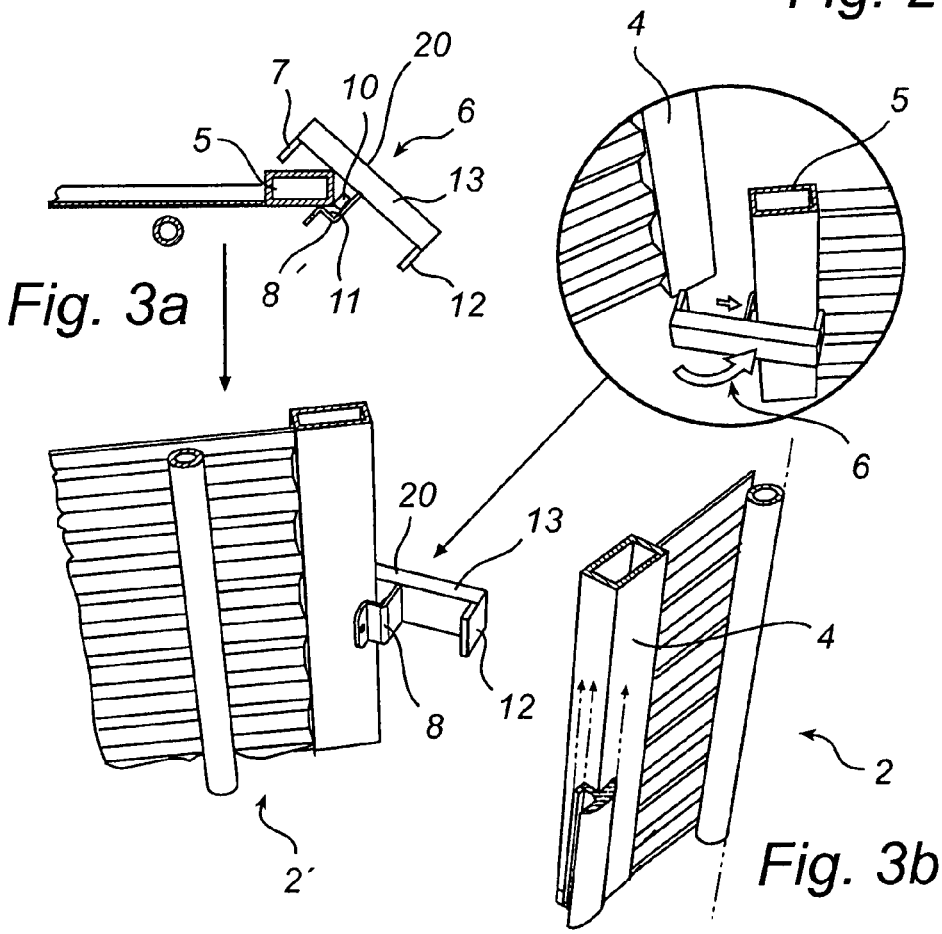

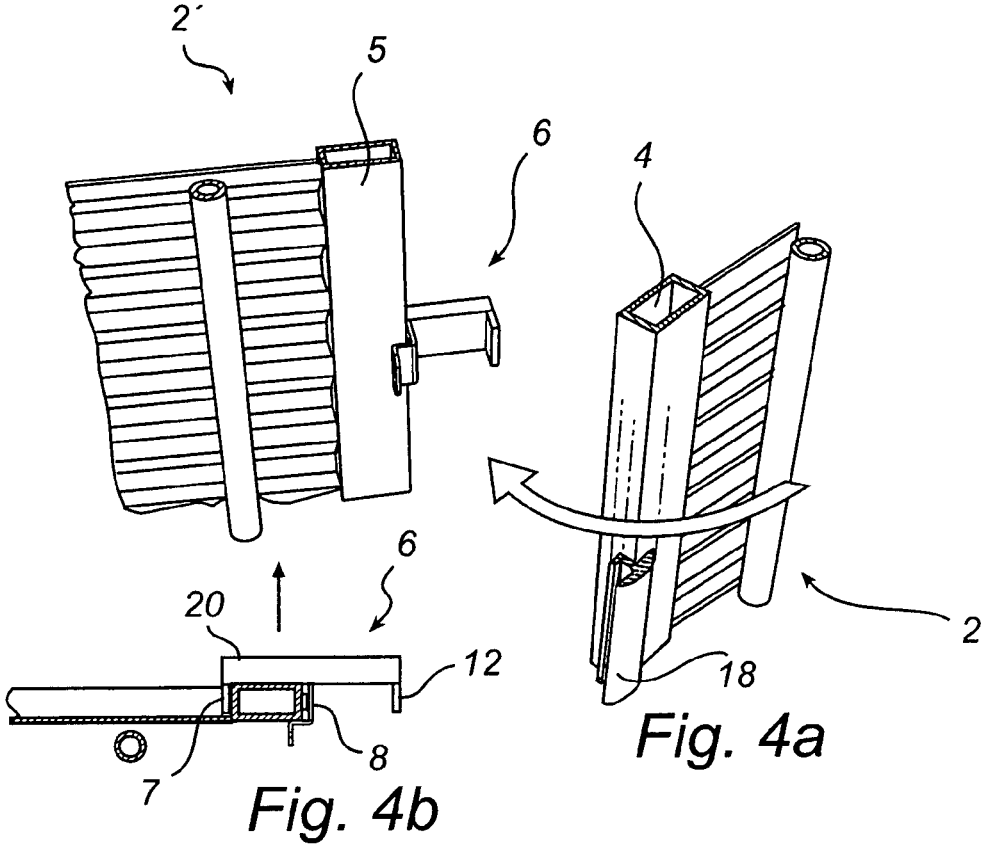
Fig. 4a
Fig. 4b
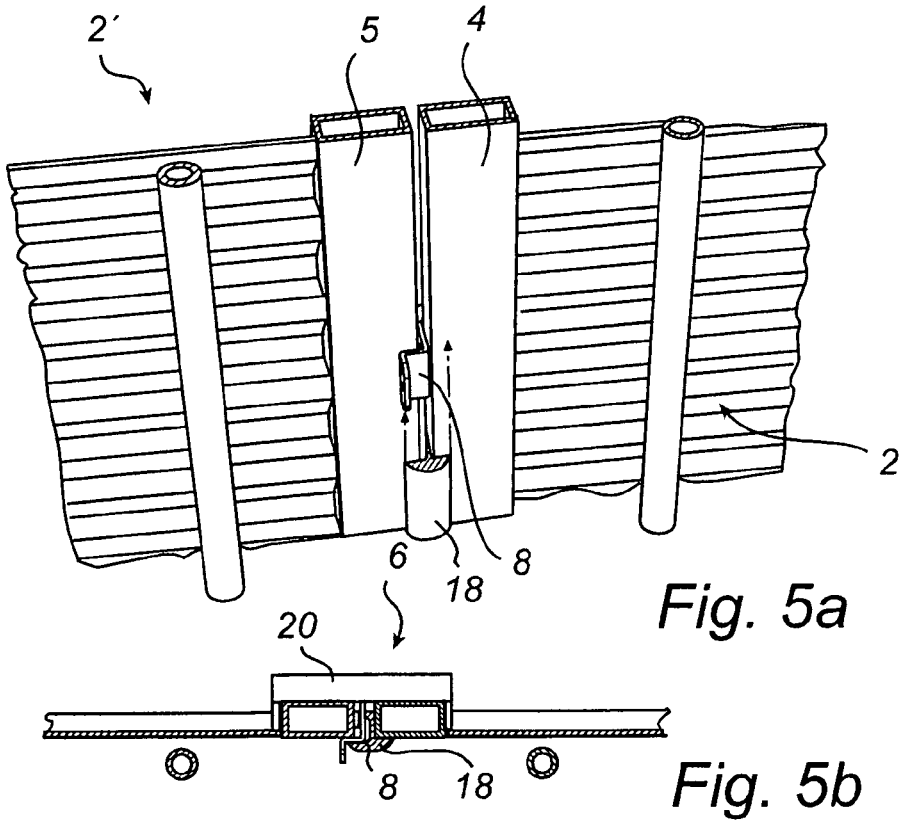
Fig. 5a
Fig. 5b

CONTAINER LOCK AND METHOD FOR LOCKING OF CONTAINER DOOR

TECHNICAL FIELD

The present invention relates to a container lock, and a method for locking of at least one door of a standardized container. The door has a frame edge portion, and further a thereto adjacent frame edge portion is provided, which frame edge portions are used to lock the door in a closed position.

BACKGROUND ART

When transporting goods, for instance, on cargo ships, trains and trucks, containers are used to a great extent. Such containers are easy to handle in loading and unloading due to standardized sizes and a robust construction. This design of containers, which are often referred to as ISO containers, allows the transported goods to be well protected in transport and also during loading and unloading. These containers are usually equipped with two doors on one of the short sides, there are mechanisms for keeping the doors in a closed position. Among prior art there are a number of different kind of fixed mounted equipment for locking of the doors, however this equipment may extend out of the exterior measure of the container, causing space consuming problems. Further this kind of fixed locking equipment demands time consuming modifications to the container for mounting of the lock equipment at the doors and/or container.

There are problems with containers when persons are trying to illegally reach the content of the container, at a storage site or during transport. Particularly leasing containers, which are usually not equipped with locking device for the door.

It is desirable with fast and efficient locking and unlocking of containers, it is also desirable to minimize the risk for unwanted opening of the container.

SUMMARY OF THE INVENTION

An object of the present invention is to provide an quick and easily handled container lock for locking of container doors.

The above object and other objects that will be evident from the following description are achieved by a container lock to be connected to frame edge portions of a container according to the appended claims.

According to one aspect of the invention, a container lock is provided for locking of at least one door of a container, said door having a first frame edge portion, and said container having a second frame edge portion positioned adjacent to said first frame edge portion in a closed position of the door, wherein said container lock comprises: an interior blocking portion, having a body adapted to extend over said first and second frame edge portions, and an engaging abutment and an extension portion extending out from said body so that, when said interior portion is arranged on the inside of said second frame edge portion, said engaging abutment and extension portion provide interacting engagement of opposite side surfaces of said second frame edge portion, and said extension portion extends from the interior of the container to the exterior of the container, and an exterior blocking means for lockable interaction with said extension portion.

An ISO container has usually two doors at one of the short sides, which are constituted of a frame and corrugated sheet metal. This design causes a recess at the edge of the frame since the dimension of the frame is larger than the dimension of the sheet metal. This recess provided by the frame edge portion is used for interacting engagement of the interior blocking portion. When both doors are closed and the interior blocking portion is mounted on the inside of the doors, i.e. in the interior of the container, the interior blocking potion extends over the first and second frame edge portions of the first and second door. The engaging abutment and extension portion interacts for engagement of opposite side surfaces of the second frame edge portion, which engagement is possible without mounting any fixed parts to the door and/or container.

Advantageously the interior blocking portion is provided with a resilient element for interacting engagement of said engaging abutment and extension portion of opposite side surfaces of said second frame edge portion.

This resilient element is compressed during mounting of the interior blocking portion on the second frame edge portion. Hence, when the resilient element expands, the resilient element will take up tolerances between the interior blocking portion and the frame edge portion, and also act as a sealing between the interior portion and the frame edge portions. The resilient portion will also provide friction between the interior blocking portion and the frame edge portion. Due to the absorbing of tolerances and provided friction the resilient element will enable that the interior blocking portion stay in place in the mounted position at the frame edge portion.

Preferably said engaging abutment and extension portion provides interacting geometrical engagement of opposite side surfaces of said second frame edge portion.

The interior blocking portion will be attached to the frame edge portion by geometrical engagement due to interaction between the abutment and resilient means, wherein the resilient means initially is compressed for enabling the engaging abutment to engage with the frame edge portion. In this way it is possible to mount the interior blocking portion with play to the frame portion, where after the interacting geometry for example by tilting of the interior blocking portion or expansion of the resilient means provides engagement. It is also possible to provide the engagement by a combination of friction and geometrical engagement.

In a preferred embodiment said extension portion is provided with an abutment for limiting movement of the interior blocking portion in direction towards the interior of the container.

In the mounted position of the interior blocking portion this abutment will interact with the second frame edge portion and prevent the interior portion from being pushed into the container, which would cause lost engagement with the frame edge portion. This abutment interacts with the outside surface of the second frame edge portion.

Advantageously said interior blocking portion having an reinforcement abutment for engagement of a side surface of said first frame edge portion corresponding to said side surface of the second frame edge portion.

By means of this reinforcement abutment and the engaging abutment the interior portion will, in closed condition of the doors, engage opposite sides of the first and second frame portions of the doors respectively. In this way the interior portion will provide a strong reinforced unit acting against an eventually pulling force used for trying to break the doors open. With this design the interior portion will be loaded with mainly a tensile stress which makes it stronger than if it would have been loaded with a bending stress.

Preferably said container lock is provided for interlocking of two doors of a container.

The second frame edge portion is usually provided on the second door, but this second frame edge portion can also be provided as a fixed frame edge portion of for example the container, and hence a door can be locked directly to a frame edge portion of the container.

Advantageously said exterior blocking means is provided with a positioning means for facilitating the engagement with said extension portion.

This positioning means is used to align the exterior means when engaging it with the extension portion of the interior portion. This is advantageous since it might be difficult to align a hole on the back side of a large exterior means with the extension portion. It is also possible to provide a second positioning means for another alignment direction of the exterior means.

Said exterior blocking means may be provided with an aperture provided for insertion of said extension portion into the aperture.

This aperture can for example be a hole in the back plate of the exterior means. The extension portion is inserted in through the aperture for enabling attachment of a locking means to the extension portion for blocking of the exterior blocking means relatively to the interior blocking portion providing a locked condition for the door.

Preferably said extension portion is provided with a hole for engagement with a lock, further said exterior blocking means is provided with a cover for covering of said lock. This cover for covering of the lock can for example be a box with an aperture directed downwards, which helps to provide a stronger exterior portion of the lock, and also makes it more difficult to access the lock in an attempt to break it. This above mentioned design further also provides a protection for the lock due to weather and an aggressive environment.

Suitably, said engaging abutment is movable in relation to said extension portion.

By arranging the engaging abutment and the extension portion movably in relation to each other, the mounting of the interior blocking portion to the second frame edge may be simplified. An operator may then increase the distance between the engaging abutment and the extension portion in the initial step of fitting the interior portion around the second frame edge portion. When the second frame edge is in position, the operator may decrease the distance again, and close contact with the second frame edge portion to the extension portion and the engaging abutment is established.

Furthermore, a movable engaging abutment may be used as an alternative or in combination with the resilient element. The use of a resilient element has for some embodiments certain advantages, as described above. However, there is for certain applications also an advantage in using a movable engaging abutment. If a door is locked with a container lock comprising a resilient element, it may be possible to open the door a few centimeters due to the compression of the resilient element. It is important to note that the possible distance the door may be opened is not enough to force the door out of a locked condition. However, not using a resilient element and instead establish close contact of the second frame edge directly with the extension portion and the engaging abutment may create a closer locking.

Furthermore, the second frame edge portion has a standardized size, and it should therefore be possible to have a standardized size of the distance between the engaging abutment and the extension portion. However, containers are subject to wear and the distance may therefore alter somewhat between different containers. Hence, it may be an advantage to be able to move the engaging abutment in relation to the extension portion in order to establish close contact with all sides of the second frame edge portion.

It may also be preferred that said reinforcement abutment is movable in relation to said extension portion.

When the interior portion has been arranged around a second frame edge portion of a container, a container door is closed and a first frame edge portion is positioned in contact with the reinforcement abutment and the extension portion.

The first and second frame edge portions have standardized sizes, and it should therefore be possible to have a standardized size of the distance between the reinforcement abutment and the extension portion. However, containers are subject to wear and the distance may therefore alter somewhat between different containers. With a fixed distance between the reinforcement abutment and the extension portion, a close contact with the first frame edge portion may not be established. It is important to note that the contact established by a fixed reinforcement abutment is sufficiently close to maintaining the door in a locked condition. However, the doors may be opened a few centimeters, which for certain applications is a disadvantage. By arranging the reinforcement abutment movable, these alterations in distance may be handled and a closer contact of the first frame edge portion and the reinforcement abutment is established.

Suitably, said interior portion is provided with locking means for locking said movable engaging abutment and/or said movable reinforcement abutment in a position in relation to said body.

It is beneficial that the movable engaging abutment and/or reinforcement abutment may not be forced out of contact with said first and second frame edge portions once the interior portion has been mounted in close contact therewith, e.g. by someone trying to force the container lock. Hence, it is preferred that an operator may lock the movable engaging abutment in a desired position in relation to the body of the interior portion and the movable reinforcement abutment should be prevented from being moved out of a preferred position.

Suitably, said movable engaging abutment and/or said reinforcement abutment is attached to a movable element, which is adapted to be guided by said body, so as to enable movement of said engaging abutment in relation to said extension portion.

The interior portion may be provided with a tubular body, which also may act as a reinforcing structure, increasing the strength of the interior portion. In this case, a movable element may be slidably arranged inside said body, for allowing said engaging abutment to be moved along said body, and, hence, be moved towards and away from said extension portion.

Arranging the movable element inside said body of the interior portion decreases the risk of damage to the movable element, and gives a container lock that is easily handled by an operator.

Preferably, said movable engaging abutment and/or said movable reinforcement abutment is spring-forced in a direction towards said extension portion.

By spring-forcing the engaging abutment and/or reinforcement abutment in that direction, the interior portion will tend to establish a close contact with a first and/or second frame edge portion without an operator moving the engaging abutment or reinforcement abutment manually towards the frame edge portion. Furthermore, when the container lock is not in use, the engaging abutment or the reinforcement abutment will abut the body of the interior portion, hence the interior portion will be in its most compact state. The interior portion will also have the movable element positioned inside the body, which reduces the risk of damage to the movable element.

When no force acts upon it, the reinforcement abutment will be positioned at its minimal distance from the extension portion, i.e. abutting a side of the body of the interior portion. When a door is to be closed and the distance provided is too small, the door will exert force on the reinforcement abutment, overcome the spring force and establish a sufficient space for the first frame edge portion.

It may further be suitable that said movable element is tiltable in relation to said body, and that said movable element and said body are provided with corresponding engagement means, which are mutually engaged when said movable element is tilted.

When the door with the first frame edge portion is closed, it is not possible for an operator to be inside the container. Hence, the reinforcement abutment may not be manually locked in a fixed position in relation to the body of the interior portion. It is therefore an advantage to provide locking or engagement means that prevents further movement of the reinforcement abutment if someone illegally tries to force the container lock.

It may further be preferred that said extension portion is movable in a direction transversal to the longitudinal extension of said body of said interior blocking portion.

The extension portion extends, in use, from the interior portion positioned inside the container and to the outside of the container. The extension portion may be so provided that it may be locked to the exterior blocking means in several different positions. It may for example be provided with a number of holes for engagement with a lock, and hence, it may be possible to choose the most suitable position of the extension portion for the current, i.e. a position in which the extension portion abuts the frame edge portion and creates a close and safe locking of the container door.

Preferably, said movable extension portion is attached to engagement means, and at least one of said engaging abutment and said reinforcement abutment is attached to corresponding engagement means, and said engagement means are arranged to be brought into mutual engagement when said extension portion is moved in a direction away from said body.

It is desirable that said movable engaging abutment and/or said movable reinforcement abutment is locked in a desired position in relation to the body of the interior portion when the container lock has been mounted to said first and second frame edge portions. A suitable manner in providing these locking means is to attach the extension portion to engagement means, and provide the engaging abutment and/or reinforcement abutment with corresponding engagement means. The locking effect may then be effected from the outside of the container, by an operator moving the extension portion in a direction away from the body of the interior portion. When the extension portion thereafter is locked to the exterior blocking means, the engaging abutment and/or the reinforcement abutment will be locked in close contact with the first and second frame edge portions, respectively.

A container comprising at least one door having a first frame edge portion, and a second frame edge portion positioned adjacent to said first frame edge portion in a closed position of the door, wherein said container is provided with a container lock comprising: an interior blocking portion, having a body adapted to extend over said first and second frame edge portions, and an engaging abutment and an extension portion extending out from said body so that, when said interior portion is arranged on the inside of said second frame edge portion, said engaging abutment and extension portion provide interacting engagement of opposite side surfaces of said second frame edge portion, and said extension portion extends from the interior of the container to the exterior of the container, and an exterior blocking means for lockable interaction with said extension portion.

A container locked with this kind of container lock will be closely and safely locked without mounting of any fixed parts to the container.

According to a method for locking of at least one door of a container, said door having a first frame edge portion, and further is said container provided with a second frame edge portion positioned adjacent to said first frame edge portion, said method further comprising the steps of;

releasable attaching an interior blocking portion, on the inside of said container, by means of geometrical locking to the opposite side surfaces of said second frame edge portion, closing said door, wherein said interior blocking portion extends over said first and second frame edge portions, and an extension portion of said interior blocking portion extends out from the interior of the container to the exterior of the container, locking an exterior blocking means with said extension portion.

The interior portion is releasable attached to the frame portion, which means that the interior portion is attached to the frame portion without any remaining attachment parts or effect on the container after the lock has been removed. The interior portion is initially mounted and held in position by geometrical and/or friction engagement with the second frame edge portion. The interior portion extends over the first and second frame edge portions on the inside of the container, which means that the interior portion is provided with a portion with an extension covering a main part of the dimension of the frame edge portions in a horizontal direction. Further the extension portion of the interior portion, in mounted position, extends out from the container through the chink of the door, i.e. the space between the door and the adjacent second frame edge portion.

The container lock according to the invention has the advantages of making it possible to lock the door/doors of a container by means of a lock that is releasable attached to the container or the doors. This means that it is not necessary to modify or attach, for example by welding, screwing, any components of the lock to the container.

Since it is not necessary to equip every container with a container lock according to the invention, the total number of locks can be reduced. For example each truck driver can have his own lock for usage on different containers when it is necessary to lock a container. Another advantageous usage of the lock is for leasing containers that does not have to be equipped with a fixed lock if the lock according to the invention is used, and hence it is easy to achieve a lockable container even for a shorter leasing period.

BRIEF DESCRIPTION OF DRAWINGS

Preferred embodiments will in the following be described in more detail with reference to the accompanying exemplary drawings, in which:

FIG. 2 shows a perspective view of two doors and an interior portion of the lock.

FIG. 3*a* discloses a top cross section view of the second frame portion and the interior portion.

FIG. 3*b* shows a perspective view of two doors and an interior portion of the lock, and a partial view from the interior of the container.

FIG. 4*a* shows in perspective a door being closed towards the interior portion.

FIG. 4*b* discloses a top cross section view of the second frame portion and the interior portion in engaged position.

FIG. 5*a* discloses a perspective view of two closed doors with the interior portion.

FIG. 5*b* discloses a top cross section view of two doors with the interior portion in engaged position.

DETAILED DESCRIPTION OF PREFERRED EMBODIMENTS

The invention will now for the purpose of exemplification be described in more detail by means of examples and with reference to the accompanying drawings.

Figure 1:
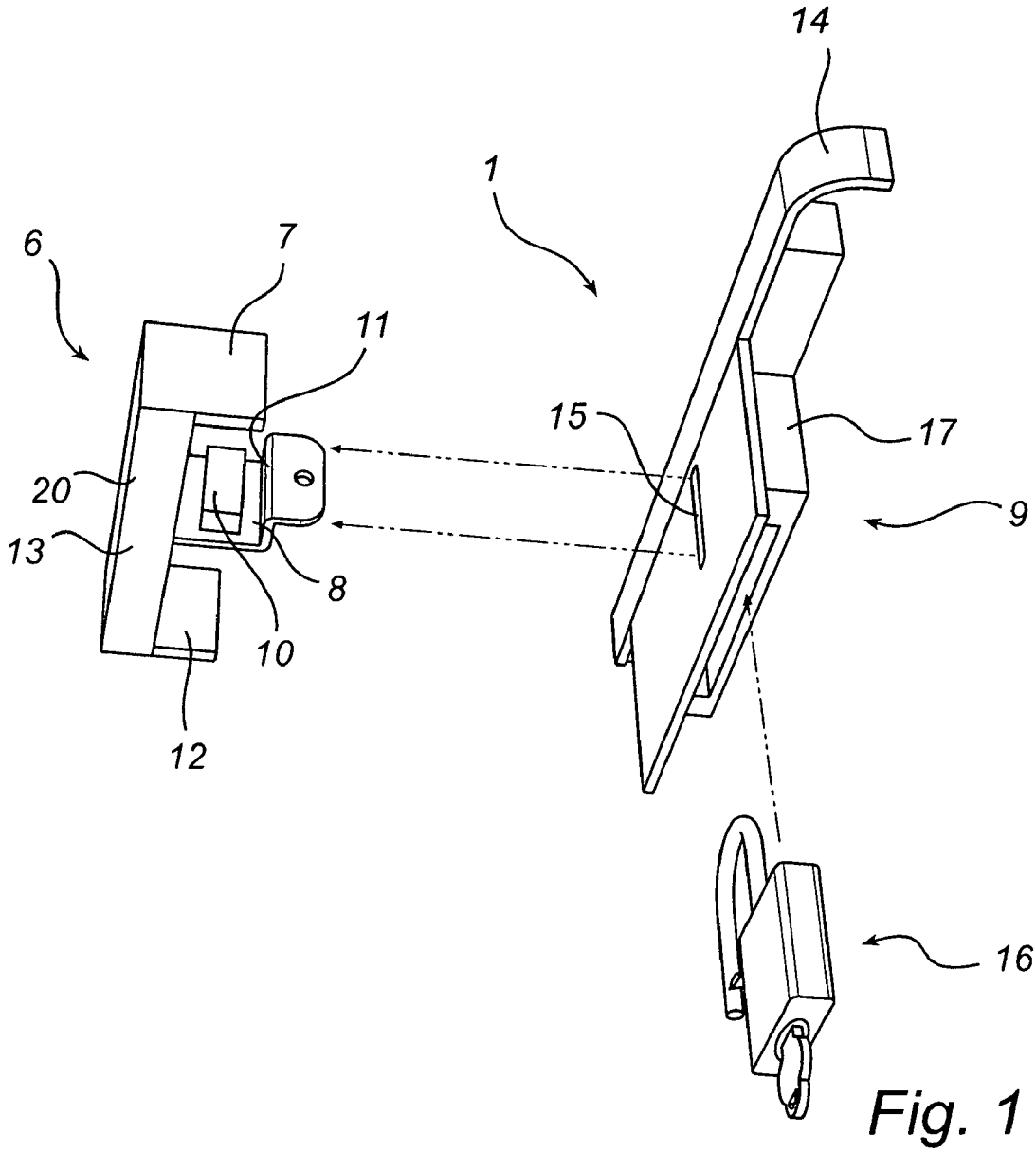
FIG. 1 shows a perspective view of a container lock according to the invention.

An embodiment of a container lock 1 according to the invention is shown in FIG. 1, wherein the interior portion 6, the exterior portion 9 and the pad lock 16 are shown. The interior portion 6 is constituted of a body 20, which in this embodiment is a reinforcing structure 13 which can be made of a square-section bar. This reinforcing structure can for example be performed as a box made of sheet metal, as flanges, solid reinforcement or other suitable design. Also the exterior portion 9 can be provided with this kind of reinforcement for achieving a strong exterior portion of the lock.

On this reinforcing structure 13 are plates welded forming an engaging abutment 7 and a reinforcement abutment 12 in each end of the reinforcing structure 13. Approximately at the middle of the reinforcing structure 13 is an extension portion 8 attached for example by welding. On the side of the extension portion 8, directed towards the engaging abutment 7, is a sealing and resilient element 10 attached, this resilient element 10 can for example be made of a resilient cellular rubber, spiral spring or other suitable element. The extension portion 8 is further provided with an abutment 11 constituted of two bends of the plate 8, a hole is also provided in the plate for engagement with the lock 16.

During engagement of the interior portion 6 to the second frame edge portion 5, the interior portion 6 is angled out from the plane of the second door 2', as shown in FIG. 2. The interior portion 6 is further inserted with the abutment 11 and reinforcing structure 13 on each side of the second frame edge portion 5, wherein the resilient element 10 is compressed (shown in FIG. 3*a-b*). Hence, during the compression of the resilient element 10 it is possible to engage the engaging abutment 7, by rotating the interior portion in FIG. 3*a* in a counter clockwise direction in the horizontal plane, on the opposite side surface of the second frame edge portion 5. Since the sealing and resilient element 10 has an extension in the direction of the frame edge portions it will provide a sealing effect for the extension portion 8, which extends from the interior of the container passing the sealing 18.

When the interior portion 6 is in the mounted position (FIG. 4*a-b*), the portion 6 will remain in this position due to that the resilient element 10 causes a force clamping the second frame edge portion 5 giving a friction force. Further, the portion 6 is also kept in position at the second frame portion 5 by geometrical locking, both acting for preventing the interior portion 6 from falling down, due to a torque from the weight of the right portion of the interior portion 6 in FIG. 4*a-b*. This torque will cause the surfaces of the engaging abutment 7 and reinforcement abutment 12 which are interacting with the second frame edge portion 5 to keep the portion 6 in position.

Further, when the interior portion 6 is in the mounted position, the abutment 11 of the extension portion 8 prevents the interior portion 6 from coming out of engagement with the second frame edge portion 5 in direction towards the interior of the container 3. The abutment 11 of the extension portion 8 does also make it possible for the extension portion to pass the sealing 18 (as shown in FIG. 5*b*), with a remaining sealing effect from the sealing 18.

After the interior portion 6 has been positioned in its mounted position the door 2 can be closed and the first frame edge portion 4 engages the reinforcement abutment 12. When the door 2 is closed the interior portion 6 is positioned (as shown in FIG. 5*a-b*) with the engaging abutment 7 and reinforcement abutment 12 on opposite side surfaces of first and second frame edge portions 4,5 respectively. Further the extension portion 8 comes out from the interior of the container through the gap between the two doors 2,2' and an eventually sealing provided in this gap can be compressed by the extension portion 8, and the sealing effect will remain.

The doors of ISO containers are usually constructed of corrugated plates with the corrugation oriented horizontally, this orientation helps the interior portion 6 to stay in place and prevents the lock from being moved downwards or upwards after the lock has been locked. Due to that the engaging abutment 7 and reinforcement abutment 12 will interact with the indentations of the corrugated plates.

Figure 6:
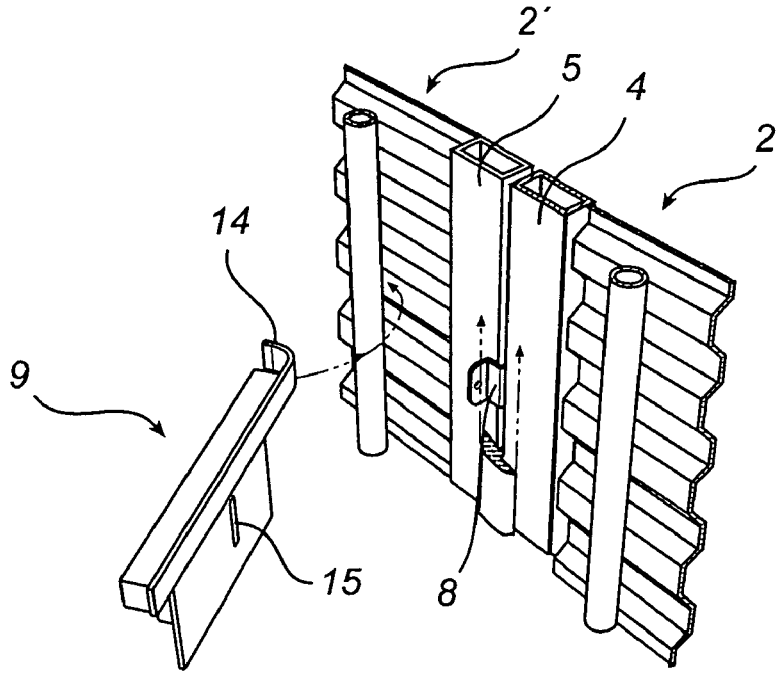
FIG. 6 shows in a perspective view two doors and the exterior portion of the lock.
Figure 7:
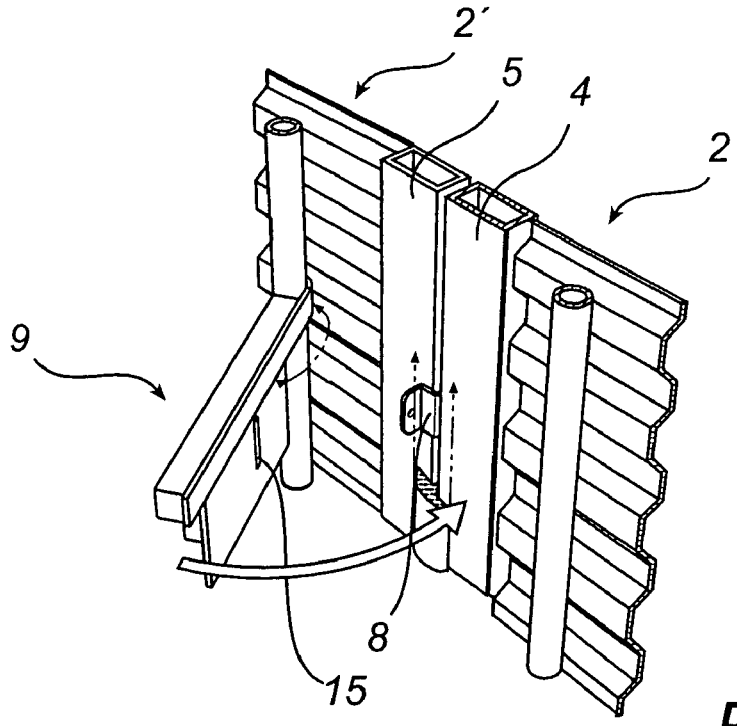
FIG. 7 shows in perspective positioning of the exterior portion on the two doors.
Figure 8:
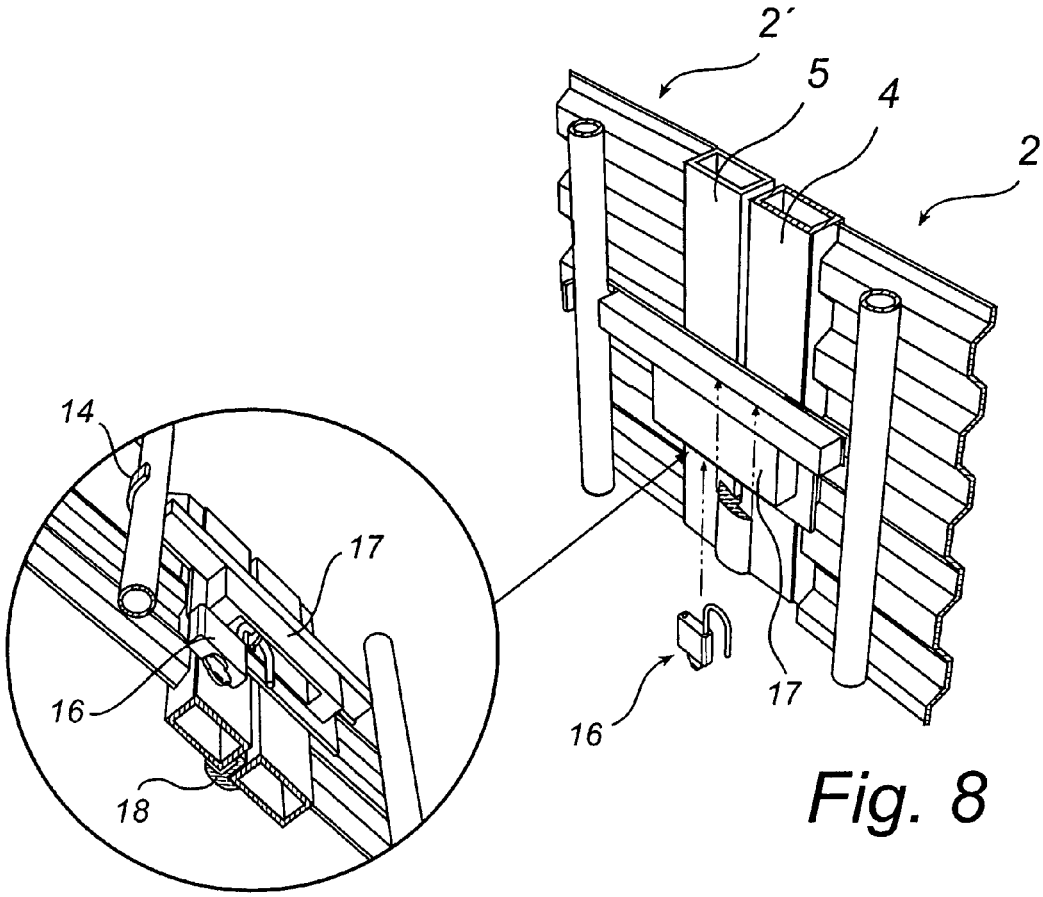
FIG. 8 discloses in perspective view the exterior portion in position at the container, and a partial view from below of the lock.
Figure 9:
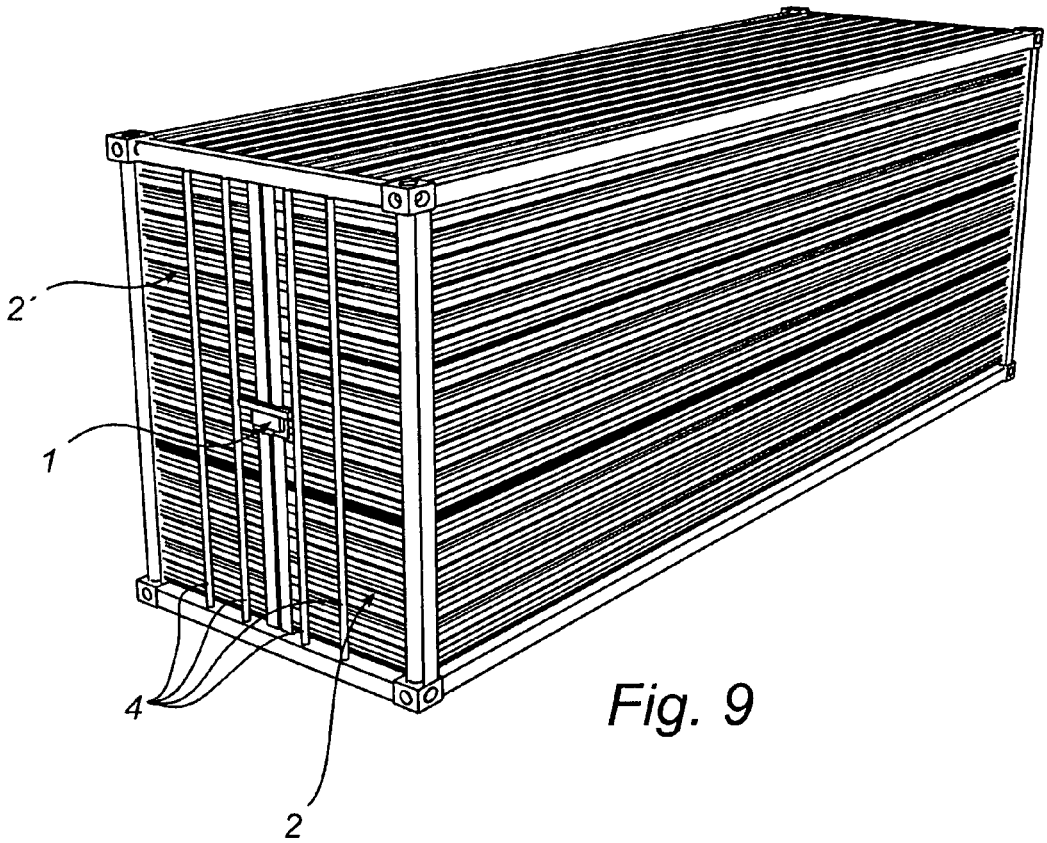
FIG. 9 shows in perspective a container with a lock according to the invention.

Usually there are vertical bars at the doors for closing of the doors 2,2'. In FIG. 6 is shown how such a bar is used for positioning of the exterior blocking means 9 by using a hook shaped positioning means 14. Since the position of the bar is standardized the position of the exterior portion 9, in the horizontal direction, will provide the aperture 15 to align correctly with the extension portion 8, and hence facilitating the portion 8 to enter the aperture 15.

When the exterior blocking means 9 has been positioned with the extension portion 8 penetrating in through the aperture 15 it is possible to attach a lock 16 in the hole at the extension portion 8, and hence the doors of the container will be locked. The fact that the positioning means 14 of the exterior blocking means 9 engages between the bar and the container helps, together with the lock 16, to block the door in locked position.

The exterior blocking means 9 is provided with a cover 17 formed as a box with an opening at the bottom, this cover can be manufactured from steel plates welded to a hood shaped box. The cover 17 protects the lock 16, which is positioned inside the cover 17 when in locked condition. The cover will further protect the lock from attempts to break the lock, the environment such as rain, snow, pollutions or other kind of contamination.

Figure 10:
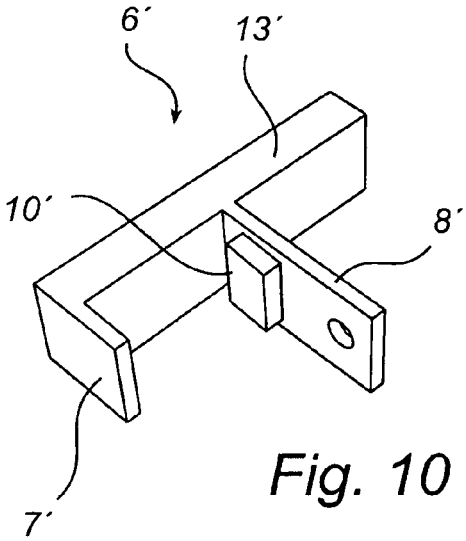
FIG. 10 shows in perspective view an alternative embodiment of the interior portion of the lock.

In FIG. 10 is shown a simplified embodiment of the interior blocking portion 6' which is constituted of a reinforcing structure 13' which can be made of a square-section bar. The reinforcing structure 13' is provided with a welded plate forming an engaging abutment 7', but the reinforcement abutment in the opposite end is excluded. Approximately at the middle of the reinforcing structure 13' is an extension portion 8' attached. On the side of the extension portion 8' directed towards the engaging abutment 7' is a sealing and resilient element 10' attached. Since this embodiment of the extension portion 8' does not have any abutment for limitation of the movement of the portion 6' in towards the interior of the container, it is possible to undesirably push the portion 6' into the container when engaging the exterior blocking means 9. The extension portion 8' in FIG. 10 is constituted of a straight plate welded to the reinforcing structure 13' and having a hole in the plate for engagement with the lock 16.

Figure 11:
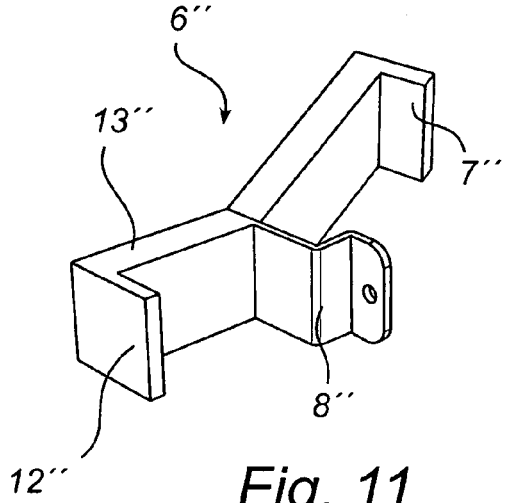
FIG. 11 shows in perspective view a further alternative embodiment of the interior portion of the lock.

In FIG. 11 is shown a further alternative embodiment of the interior blocking portion 6", which is designed in the same way as the preferred embodiment except for the part of the reinforcing structure 13" extending from the extension portion 8" to the engaging abutment 7", which is angled upwards (or downwards) providing a longer diagonal distance between the portion 8" and the abutment 7" compared to the corresponding projected horizontal distance. This makes it possible to mount the interior portion 6" to the second frame edge portion 5 by angling/tilting of the portion 6" around a horizontal axis. In this embodiment it may be possible to engage the portion 6" with the second frame portion 5 with out a resilient element, since the distance between the portion 8" and the abutment 7" can be made to fit the dimension of the frame portion 5 more exact.

In FIGS. 12 to 16 are shown five further embodiments of the present invention. The five different embodiments are based on the same general principle as described above, and the description below will merely focus on the differences between these embodiments and the ones mentioned above. The differences between these embodiments and the ones mentioned above relate to the design of the interior portion 6. The exterior blockings means 9 may be the same and it will not be discussed for each of these embodiments. Throughout the description, like reference numerals as above will be used for like components.

Figure 12:
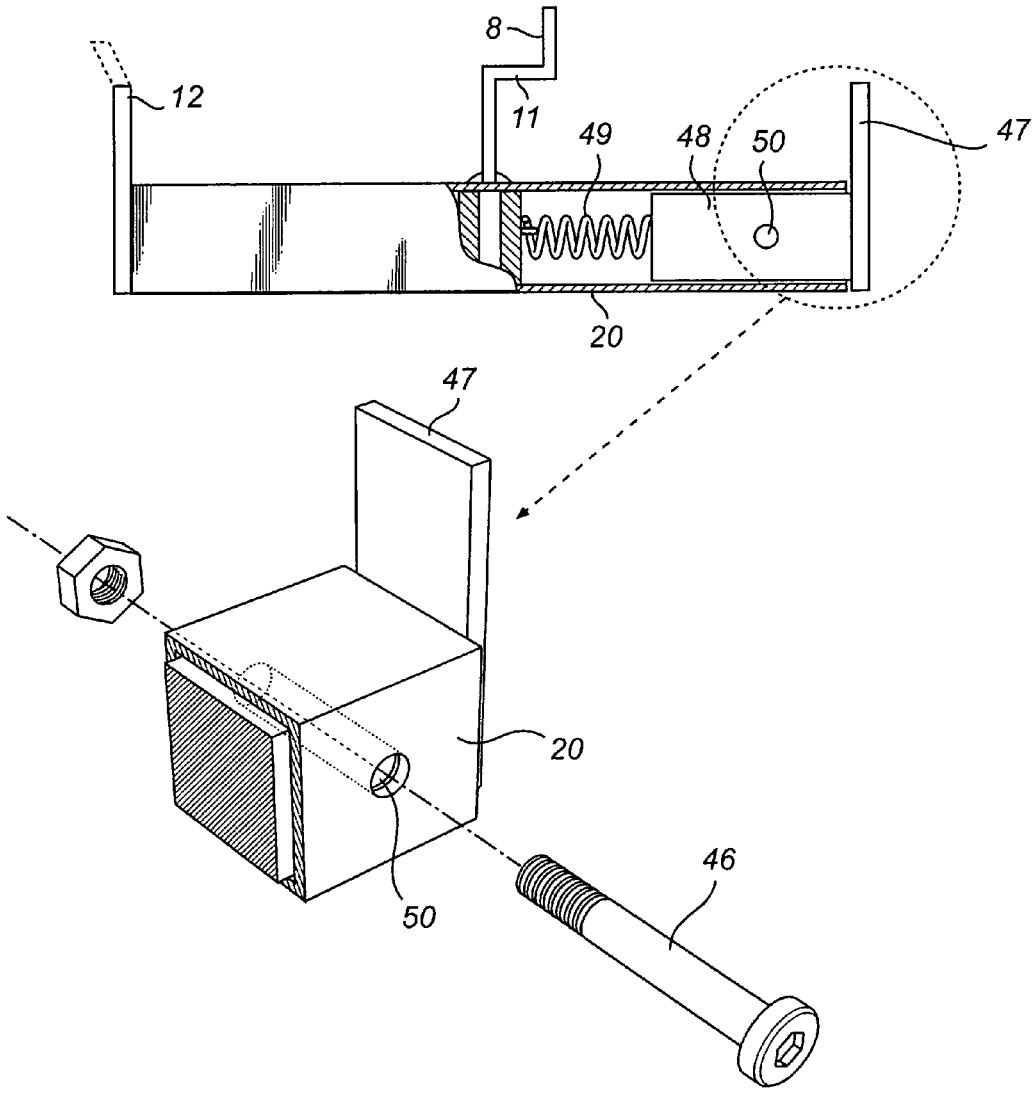
FIG. 12 shows in cross-sectional view a further alternative embodiment of the interior portion of the lock.

In FIG. 12 is an embodiment shown of the interior portion 6 comprising a body 20 provided with an engaging abutment 47 and a reinforcement abutment 12 at opposite ends thereof. Approximately at the middle of the body 20 is an extension portion 8 attached, as described above. The reinforcement abutment 12 and the extension portion 8 are similar to the ones described above, and may be attached to the body 20 by, for example, welding.

As may be seen in FIG. 12, the body 20 comprises in this embodiment a tubular section. The engaging abutment 47 is arranged at a movable element 48, which is movable in the interior of the tubular section of the body 20, in essentially the longitudinal direction of the body 20.

The movable engaging abutment 47 is arranged at one side of the body of the interior portion, in its longitudinal direction. The movable element 48 is biased, e.g. by means of a spring 49, towards the middle of the interior portion 6, i.e. towards a position in which the distance between the extension portion 8, which is arranged substantially at the middle of the body 20, and the engaging abutment 47 is as small as possible. Hence, when the engaging abutment is moving towards the extension portion, it is also moving in a direction towards the middle of said body 20. However, the spring 49 cannot move the engaging abutment 47 further than to the end side of the body 20. The spring force biasing the engaging abutment 47 towards the position where it is contact with the body 20 is not stronger than that an operator may overcome it and move the engaging abutment 47 further away from the extension portion 8.

The interior portion 6 is also provided with locking means 50, which may lock the engaging portion 47 in a desired position in relation to the body 20. The locking means 50 is shown schematically in FIG. 12 as a bolt 46 with a nut, but it may for example also be a snap fitting, a clamp fitting or a simple pin that may be inserted through a corresponding recess through the body 20 and the movable element 48.

During engagement of the interior portion 6 to the second frame edge portion 5, the locking means 50 is released, if necessary, and an operator moves the engaging abutment 47, and consequently the movable element 48, away from the extension portion 8. Depending on the configuration, i.e. how much it is possible to displace the engaging abutment 47, it may, as described above, also be necessary to angle the interior portion 6 out from the plane of the second door 2', as shown in FIG. 2.

Further, the interior portion 6 is arranged in the position shown in FIG. 4*b*, i.e. with the abutment 11 and body 20 on each side of the second frame edge portion 5 and with the engaging abutment 47 and the extension portion 8 on the opposite side surfaces of the second frame edge portion 5. Thereafter, the operator moves, aided by the spring 49, the engaging abutment 47 towards the extension portion 8 until the engaging abutment 47 is in contact with the side of the second frame edge portion 5. The locking means 50 is thereafter operated back to the locked position, i.e. the position in which movement of the movable element 48 and engaging abutment 47 is prevented.

When the interior portion 6 is in the mounted position (similar to FIG. 4*a-b*), the portion 6 will be held in this position due to the contact forces the clamping the interior portion 6 to the second frame edge portion 5. Further, when the interior portion 6 is in the mounted position, the abutment 11 of the extension portion 8 prevents the interior portion 6 from coming out of engagement with the second frame edge portion 5 in direction towards the interior of the container 3. The abutment 11 of the extension portion 8 also makes it possible for the extension portion 8 to pass the sealing 18 (as shown in FIG. 5*b*), with a remaining sealing effect from the sealing 18.

After the interior portion 6 has been positioned in its mounted position, the door 2 can be closed and the exterior blocking means can be attached, as described above for the previous embodiments.

The interior portion according to this embodiment has been described with a spring 49 biasing the engaging abutment 47 towards the extension portion 8. This may however not be necessary and the movable element may be moved along the body 20, in both directions, only by manual force applied by an operator.

Figure 13:
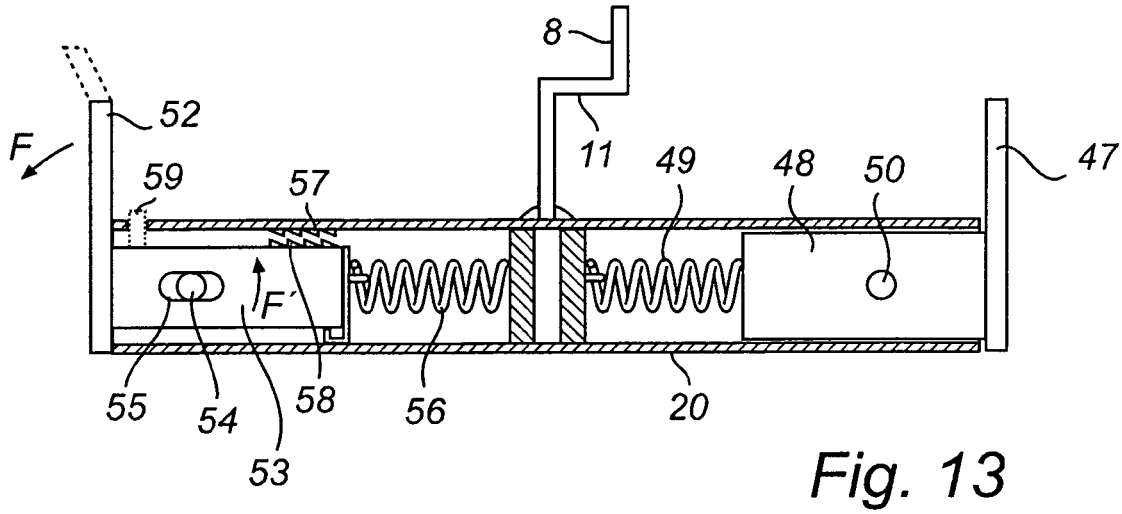
FIG. 13 shows in cross-sectional view a further alternative embodiment of the interior portion of the lock.

In FIG. 13 another embodiment is disclosed. In this embodiment the extension portion 8, the engaging abutment 47, the movable element 48, the spring 49 and the locking means 50 are the same as in the embodiment disclosed in FIG. 12.

A reinforcement abutment 52, corresponding to the reinforcement abutment 12 of the previously described embodiments, is arranged at the opposite end of the body 20, in relation to the engaging abutment 47. The reinforcement abutment 52 is attached to a movable element 53 that is arranged inside the tubular body 20. The movable element 53 is further provided with a recess 55 through which a pin 54 may extend. The pin 54 may be fixedly arranged at the inside of the body 20, e.g. by welding, in order to hold the movable element 53 in relation to the body 20. Alternatively, the body 20 may also be provided with corresponding holes through which the pin 54 may extend. The recess 55 is in this embodiment elongate, and the movable element 53 may therefore be displaced a distance in the longitudinal direction of the body 20 even when the pin 54, fixedly arranged in relation to the body 20, is extending through the recess 55.

The movable element 53 has, as may be seen in FIG. 13, a smaller diameter than the interior of the body 20 and, hence, the movable element may also tilt around the pin 54. The movable element 53 is held in an unforced position by means of a spring 56. The movable reinforcement abutment 52 is, as mentioned above, arranged at one side of the body 20, in its longitudinal direction. The extension portion 8 is arranged substantially at the middle of said body. Hence, when the reinforcement abutment 52 is moving towards the extension portion 8, it is also moving in a direction towards the middle of the body 20. However, the reinforcement abutment can only move so far towards the extension portion 8 that it abuts an end side of the body 20.

The movable element 53 is further provided with protrusions 58, or other suitable engagement means such as hooks or splines, in the proximity of its end portion that is directed towards the longitudinal middle of the body 20. The body 20 is provided with corresponding protrusions 57, or other suitable corresponding engagement means such as hooks or splines. The corresponding engagement means 57, 58 constitutes a locking means that, when locked, prevents the reinforcement abutment 52 from movement in relation to the body 20.

In use, when the interior portion 6 has been arranged at its position and is engaging both the second frame edge portion 5 and the first frame edge portion 4, the arrangement described above will assist in maintaining a closer locking of the container doors. The reinforcement abutment 52 may, as described above, be displaced in relation to the body 20. The frame edge portions 4, 5 have a standardized size. However, small variations may occur, e.g. due to wear of the containers. Hence, when the reinforcement abutment has a fixed position in relation to the body and the extension portion 8, as in the previous embodiments, a close contact between the reinforcement abutment 12 and the first frame edge portion 4 is not always achieved. Now, with the reinforcement abutment 52 being movable, a close contact may be achieved. When the interior portion 6 has been mounted to the second frame portion 5 of the door 2', as may be seen in FIG. 4*b*, the door may be closed as in FIG. 4*a*. When the door 2 is closed, a side of the first frame edge portion 4 may come into contact with and displace the reinforcement abutment 52. However, the spring 56, biasing the reinforcement abutment 52 towards the middle of the body 20, will displace the reinforcement abutment 52 towards its initial position and close contact with the first frame edge portion 4 is achieved. As may be seen in FIG. 13, the reinforcement abutment may also be provided with an angular outer portion, which assists in guiding the door 2 in position when it is being closed.

If someone exerts force on the doors 2, 2', the exterior blocking means 9 or the extension portion 8, when the container has been locked, the door 2 will tend to open a short distance. However, the first frame edge portion 4 will in that case, due to the close contact, exert force on the reinforcement abutment 52 and this force will cause the reinforcement abutment 52 to move and/or tilt somewhat away from the body 20, in the direction shown by the arrow F in FIG. 13. More specifically, the force will be applied on the outer end of the reinforcement abutment 52, which brings the movable element to tilt around the pin 54, in the direction shown by arrow F' in FIG. 13. When the movable element 53 tilts, the corresponding engaging means 57, 58 will engage each other and prevent further movement of the movable means 53, and hence the reinforcement abutment 52. By this, it will not be possible to open the door 2 any further, and a closer locking of the container doors is established, as compared to the previously described embodiments.

It is also possible to provide the movable element 53 with a contact element 59, which extends from the movable element 53 and out from the body 20 (shown in phantom lines in FIG. 13). This contact element 59 will be displaced when the door 2 is moved to the closed position, and the movable element 53 will then tilt in the direction of arrow F', and the engaging means will be engaged, thus preventing any further movement of the reinforcement abutment. Hence, an even closer locking of the container is established.

Figure 14:
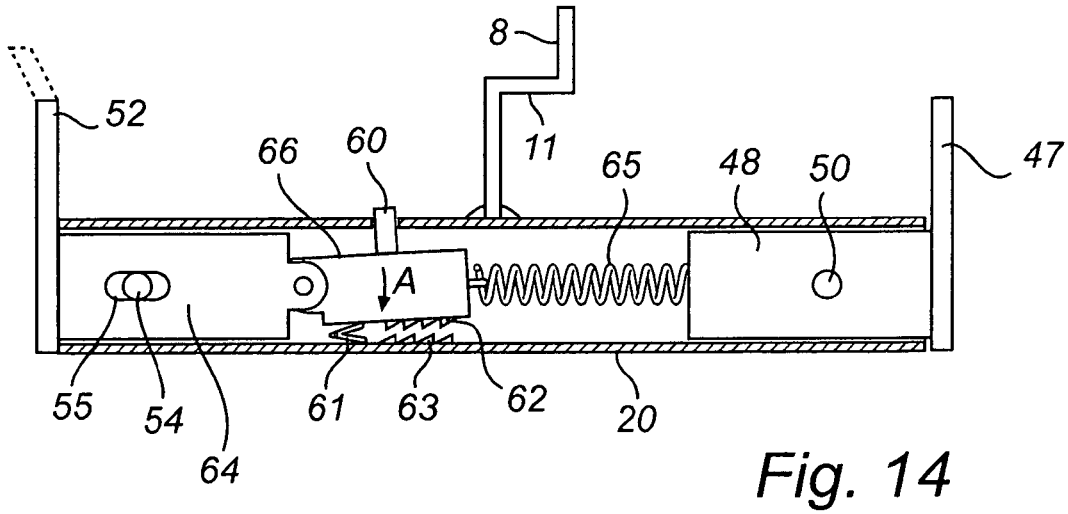
FIG. 14 shows in cross-sectional view a further alternative embodiment of the interior portion of the lock.

In FIG. 14, yet another embodiment is shown. The engaging abutment 47, the movable element 50 and the locking means 50 are similar to the embodiment disclosed in FIG. 13. In this embodiment the reinforcement abutment 52 is, similar to the embodiment described in relation to FIG. 13, attached to a movable element 64, which is provided with an elongate recess 55 through which a pin 54 may extend. The pin may also, in accordance with the embodiment disclosed in FIG. 13, be fixedly arranged to the body 20 or extend through holes in the body 20 in order to be secured thereto. Hence, the movable element 64 is, also in accordance with the previous embodiment, displaceable along the longitudinal axis of the body 20 in order to enable a close contact with the extension portion 8 and the reinforcement abutment 52 to the first frame edge portion 4. The movable element is also, as may be seen in FIG. 14, biased by means of a spring 65 towards the middle of the body 20 in order to assist in achieving the close contact to the first frame edge portion 4. However, the movable unit 64 is not tiltable around the pin 54.

Further, the movable element 64 is attached to a locking means 66 which is provided with a contact element 60 extending from the locking element and to the outside of the body 20. The locking element is further provided with protrusions 62, or other suitable engagement means such as hooks or splines. The interior of the body 20 is provided with corresponding engagement means 63. The corresponding engagement means 62, 63 constitutes a locking means that, when locked, prevents movement of the reinforcement abutment 52, in relation to the body 20. A pressure spring 61 is arranged to bias the locking element 60 towards a position in which the corresponding engagement means 62, 63 is not engaging each other. In this position the movable element 64 and the reinforcement abutment 52 may be moved along the longitudinal axis of the body 20.

When the interior blocking portion 6 has been arranged in its use position around the second frame edge portion 5, as shown in FIG. 4*b*, the door 2 may be closed. The first frame edge portion 4 is then, as described in relation to the embodiment shown in FIG. 13, engaging the reinforcement abutment 52 and eventually forces it in a direction so that the distance to the extension portion 8 is increased. Also in this embodiment may the reinforcement abutment be provided with an angular outer portion that assists in guiding the door 2 into the desired position. However, when the door 2 is closed, the contact element 60 will be pushed towards the interior of the body 20, in the direction of arrow A in FIG. 14, hence pressing against the locking element 66, overcoming the force exerted by the pressure spring 61 and bringing the engagement means 62, 63 into contact. Then, the movable element 64 and the reinforcement abutment 52 are locked and may not be moved along the longitudinal axis of the body.

Figure 15:
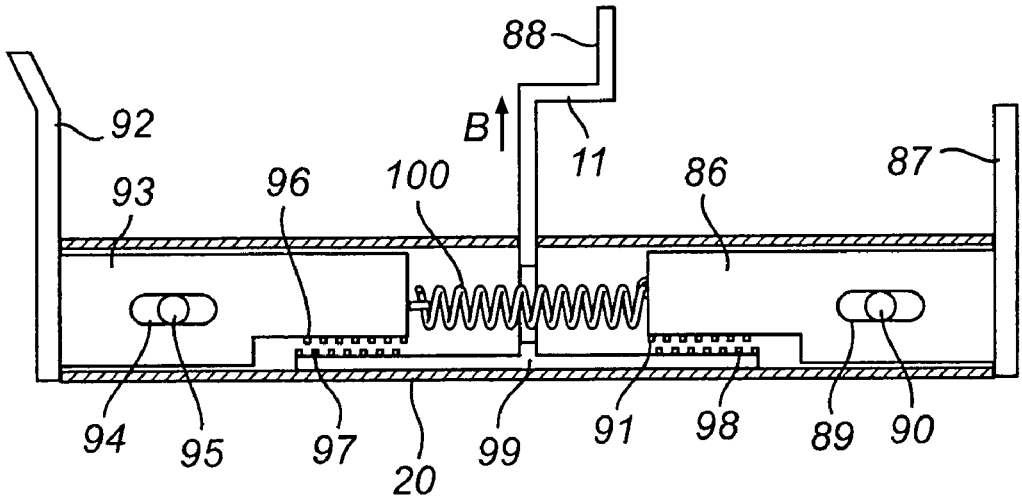
FIG. 15 shows in cross-sectional view a further alternative embodiment of the interior portion of the lock.
Figure 16:
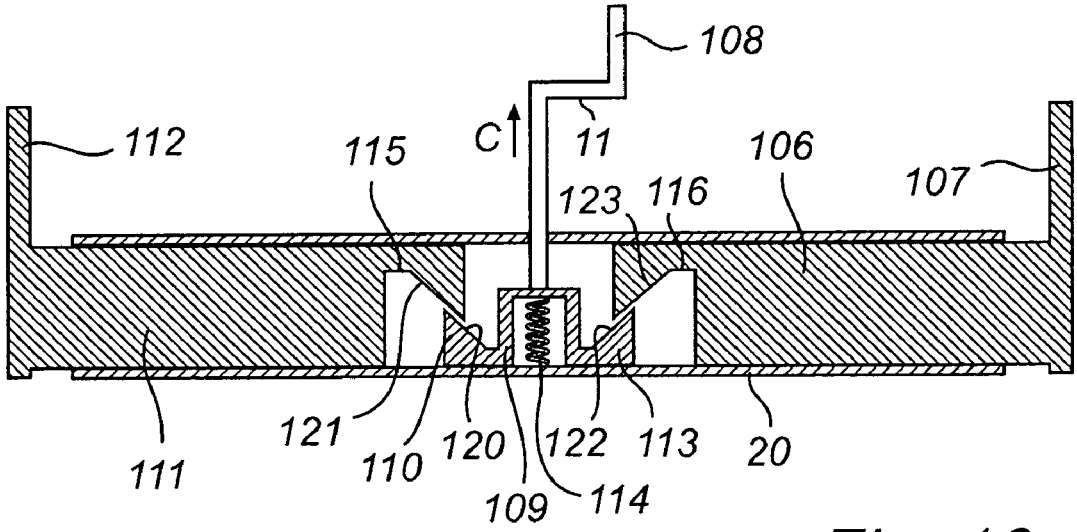
FIG. 16 shows in cross-sectional view a further alternative embodiment of the interior portion of the lock.

FIGS. 15 and 16 shows yet another two further embodiments, which both has the common feature that the extension portions 88, 108 of the interior portion 6 are movable in a transversal direction to the longitudinal axis of the body 20, as depicted by arrows B and C, respectively.

The embodiment of the interior portion 6 in FIG. 15 comprises a movable engaging abutment 87 attached to a movable element 86, a movable reinforcement abutment 92 attached to a movable element 93, at the other end of the body 20, and as mentioned above, a movable extension portion 88. The movable elements 86, 93 are each provided with an elongate recess 89, 94, through which a respective pin 90, 95 is arranged. The respective pins 90, 95 are secured in a fixed position in relation to the body 20, and, hence, each of the movable elements 86, 93 may be displaced a certain distance along the longitudinal axis of the body. Furthermore, each of the movable elements 86, 93 is provided with protrusions 91, 96, or other suitable engagement means such as hooks or splines. The extension portion 88 is further attached to a movable element 99. The movable element 99 is provided with engagement means 97, 98, corresponding to the engagement means 91, 96 of the movable elements 86,93, so that, when said engagement means 91, 98; 96, 97 are mutually engaged, displacement of each of the movable elements 86, 93 is prevented. Thus, the corresponding engagement means 91, 98; 96, 97 constitutes a locking means that, when locked, prevents movement of each of the engaging abutment 87 and the reinforcement abutment 92 in relation to the body 20.

As may also be seen in FIG. 15, a spring 100 is provided to bias the two movable elements 86, 93 towards each other. However, spring 100 may also be replaced with two separate springs (not shown), each of them biasing each one of the movable elements 86, 93 towards the middle of the body 20.

When using the container lock, the engaging abutment 87 is first, by an operator, spaced further apart from the extension portion 88, in accordance with the previous embodiments. This is possible due to the elongate hole 89 provided in the movable element 86. The interior portion 6 is thereafter arranged around the edges of a second frame edge portion 5. When the operator releases his grip of the engaging abutment 87, the spring 100 will force the movable element 86 towards the middle of the body, and hence, establish a close contact with the second frame edge portion 5 and the engaging abutment 87 and the extension portion 88. The door 2 is thereafter closed as has been described for the previous embodiments, positioning the reinforcement abutment 92 in close contact with a first frame edge portion 4, and the extension portion 88 extending from the interior of the container towards the outside, as may be seen in FIGS. 5*a* and 5*b*. As stated above, the reinforcement abutment 92 is movable in the longitudinal direction and biased towards the middle of the body 20. Hence, when the door 2 closes, the first frame edge portion 4 may, if necessary, displace the reinforcement abutment 92. However, the reinforcement abutment 92 will, when the first frame edge portion 4 is in place, establish close contact due to the spring 100. The reinforcement abutment may also in this embodiment be provided with an angular outer portion in order to guide the door 2 into position.

By displacing the extension portion 88 further outwards from the container doors 2, 2', i.e. in the direction of arrow B in FIG. 15, e.g. when securing the blocking means 9 and the lock 16 to the extension portion 88, the engagement means 96, 97; 91,98, will come into mutual engagement and, hence, prevent the movable elements 86, 93 from further movement.

The embodiment disclosed in FIG. 16 has a movable engaging abutment 107 attached to a movable element 106, a movable reinforcement abutment 112 attached to a movable element 111, at the other end of the body 20, and as mentioned above, a movable extension portion 108. Each of the movable elements 106, 111 is provided with engagement means in the form of a profiled wedge-shaped portion 115, 116, respectively.

The extension portion 108 is further attached to a movable element 109. The movable element 109 is provided with two engagement means in the form of wedges 110, 113, which are arranged to be brought into engagement with the profiled portions 115, 116, respectively. The corresponding wedge-shaped engagement means 110, 115; 113, 116 constitutes a locking means that, when locked, prevents movement of each of the reinforcement abutment 112 and the engaging abutment 107 in relation to the body 20. The extension portion 108 and the movable element 109 are biased, by means of a pressure spring 114, towards a position in which the wedges 110, 113 are not in engagement with the profiled portions 115, 116 of the movable elements 106, 111.

When using the container lock, the engaging abutment 107 is first, by an operator, spaced further apart from the extension portion 108. This is possible due to the fact that the profiled portion 116 is not in contact with or locked by the wedge 113. The interior portion 6 is thereafter arranged around the edges of a second frame edge portion 5. The door 2 is thereafter closed, as has been described for the previous embodiments, positioning the reinforcement abutment 112 in contact with a first frame edge portion 4, and the extension portion 108 extending from the interior of the container towards the outside, as shown in FIGS. 5*a* and 5*b*. The reinforcement abutment 102 is, since the profiled portion 115 is not in contact with or locked by wedge 110, movable in the longitudinal direction of the body 20.

When the doors 2, 2' have been closed, an operator may, by overcoming the force of the pressure spring 114, displace the extension portion 108 further out from the container doors 2, 2', i.e. in the direction shown by arrow C in FIG. 16, e.g. when securing the blocking means 9 and the lock 16 to the extension portion 108. This movement will bring the wedges 110, 113 into engagement with the profiled wedge-shaped portions 115, 116, respectively. Due to the corresponding slide surfaces 120, 121; 122, 123 of the wedges 110, 113 and the profiled portions 115, 116, respectively, the movable elements 111, 106 will be displaced towards the middle of the body 20, and hence, the abutment engagement 107 will be brought into close contact with the second frame edge portion 5, and the reinforcement abutment 112 will be brought into close contact with the first frame edge portion 4. When the extension portion 108 thereafter is locked to the blocking means 9, in the position where it has been displaced away from the body 20, the movable elements 106, 111 will be prevented from further movement.

Although the present invention has been described in connection with particular embodiments thereof, it is to be understood that various modifications, alterations and adaptations may be made by those skilled in the art without departing from the spirit and scope of the invention.

For example, the lock 16 has been described as a separate lock. The function of the lock is to prevent the interior portion 6 and the exterior blocking means 9 to be separated once locked. However, it is possible to form the lock integral with the exterior blocking means 9. Furthermore, the lock does not have to be a key-operated lock, it may, for example, be electronically operated or it may be a code lock.

Furthermore, the shape of the exterior blocking means 9 may be altered. A portion of the exterior blocking means 9, i.e. the surface that surround the aperture 15, may in use be in contact with the sealing 18. It may be desirable to contour or shape that surface with a bend or a recessed area so that a space for the sealing 18 is provided in the surface. With such a modification, the blocking means 9 may be positioned closer to the container doors and walls when the lock is in use.

Furthermore, it is possible to integrate additional features into the container lock. It may for example be desirable to provide either or both of the exterior blocking means 9 and the interior portion 6 with electronic circuits and power supplies. By providing electricity to the container lock, it is possible to provide the lock with additional features. It may, for example, be desirable to provide the lock with a positioning system, such as GPS. It may then be possible to track the container locks, and the container that it is locking.

Another possible modification, when the container lock is provided with electricity, is to utilize electricity for displacing the movable element and the engaging abutment of the embodiment disclosed in FIG. 12 or the movable elements and the engaging abutment and/or the reinforcement abutment disclosed in FIGS. 13 to 16 of the interior portion. Each or both of the movable elements, and consequently the engaging abutment and/or the reinforcement abutment, may then be connected to a power means or actuator that displaces them in the longitudinal direction of the body 20. The power actuator may for example be electrical, mechanical, pneumatic or hydraulic. Furthermore, the power actuator may be operated from a distance, e.g. from outside the container. For example, it may be possible to provide an electronically activated cylinder, e.g. a hydraulic cylinder in the body 20. The cylinder may be attached to the movable element disclosed in the embodiment of FIG. 12 or one or both of the movable elements disclosed in the embodiments of FIGS. 13 to 16, and hence, to one or both of the reinforcement abutment and engaging abutment. It may further be possible to provide each of the interior portion 6 and the blocking means 9 with corresponding contacts or circuits and that the cylinder is activated when a closed circuit is achieved, i.e. when the exterior blocking means 9 is locked to the extension portion 8, 88, 108 of the interior portion and/or the corresponding circuits come into contact. When the interior portion and the blocking means are not connected, the cylinder is then not activated and an operator or a closing door may displace the engaging and reinforcement abutments to position them in a desired position. When the closed circuit thereafter is established, the hydraulic cylinder will move the engaging abutment and/or the reinforcement abutment towards the extension portion and into close contact with the respective frame edges of the container, with a pulling motion. Hence, a desired close contact locking is achieved. The cylinder will not become deactivated until the power is turned off, i.e. the blocking means 9 is unlocked and removed from the contact with the interior portion 6. However, when the cylinder is deactivated, it is possible to move the engaging abutment and/or reinforcing abutment away from the extension portion, and hence, remove the lock from the container.

Furthermore, the body 20 may also be provided by a beam with one side open, as a U-shaped beam, or as a solid element, such as a beam or a plate.

The invention claimed is:

1. A container lock for locking of at least one door of a container, said at least one door having a first frame edge portion, and said container having a second frame edge portion positioned adjacent to said first frame edge portion in a closed position of the at least one door, said container lock comprising:

an interior blocking portion, having a body adapted to extend over said first and second frame edge portions, and an engaging abutment and an extension portion extending out from said body so that, when said interior blocking portion is arranged on an inside of said second frame edge portion, said engaging abutment and extension portion provide interacting engagement of opposite side surfaces of said second frame edge portion, and said extension portion extends from the interior of the container to the exterior of the container, and an exterior blocking portion for lockable interaction with said extension portion, wherein said engaging abutment is movable in relation to said extension portion, and said movable engaging abutment is spring-forced in a direction towards said extension portion.

2. A container lock according to claim 1, wherein said interior blocking portion is provided with a resilient element for interacting engagement of said engaging abutment and extension portion of opposite side surfaces of said second frame edge portion.

3. A container lock according to claim 1, wherein said engaging abutment and said extension portion provide interacting geometrical engagement of opposite side surfaces of said second frame edge portion.

4. A container lock according to claim 1, wherein said extension portion is provided with an abutment for limiting movement of the interior blocking portion in direction towards the interior of the container.

5. A container lock according to claim 1, wherein said interior blocking portion having a reinforcement abutment for engagement of a side surface of said first frame edge portion corresponding to one of the opposite side surfaces of the second frame edge portion.

6. A container lock according to claim 1, wherein said container lock is provided for interlocking of two doors of the container.

7. A container lock according to claim 1, wherein said exterior blocking portion is provided with a positioning device for facilitating the engagement with said extension portion.

8. A container lock according to claim 1, wherein said exterior blocking portion is provided with an aperture provided for insertion of said extension portion into the aperture.

9. A container lock according to claim 1, wherein said extension portion is provided with a hole for engagement with a lock.

10. A container lock according to claim 9, wherein said exterior blocking portion is provided with a cover for covering of said lock.

11. A container lock according to claim 1, wherein said interior blocking portion is provided with a locking device for locking said movable engaging abutment in a position in relation to said body.

12. A container lock according to claim 1, wherein said movable engaging abutment is attached to a movable element, which is adapted to be guided by said body, so as to enable movement of said engaging abutment in relation to said extension portion.

13. A container lock according to claim 5, wherein said reinforcement abutment is movable in relation to said extension portion.

14. A container lock according to claim 13, wherein said interior blocking portion is provided with a locking device for locking said movable reinforcement abutment in a position in relation to said body.

15. A container lock according to claim 13, wherein said reinforcement abutment is attached to a movable element, which is adapted to be guided by said body, so as to enable movement of said reinforcement abutment in relation to said extension portion.

16. A container lock according to claim 13, wherein said movable reinforcement abutment is spring-forced in a direction towards said extension portion.

17. A container lock according to claim 15, wherein said movable element further is tillable in relation to said body, and wherein said movable element and said body are provided with corresponding an engagement device, which are mutually engaged when said movable element is tilted.

18. A container lock according to claim 1, wherein said extension portion is movable in a direction transversal to the longitudinal extension of said body of said interior blocking portion.

19. A container lock according to claim 18, wherein said movable extension portion is attached to an engagement device, and wherein at least one of said engaging abutment and said reinforcement abutment is attached to corresponding engagement device, and wherein said engagement device are arranged to be brought into mutual engagement when said extension portion is moved in a direction away from said body.

20. A container lock for locking of at least one door of a container, said at least one door having a first frame edge portion, and said container having a second frame edge portion positioned adjacent to said first frame edge portion in a closed position of the at least one door, said container lock comprising:

an interior blocking portion, having a body adapted to extend over said first and second frame edge portions, and an engaging abutment and an extension portion extending out from said body so that, when said interior blocking portion is arranged on an inside of said second frame edge portion, said engaging abutment and extension portion provide interacting engagement of opposite side surfaces of said second frame edge portion, and said extension portion extends from the interior of the container to the exterior of the container, and an exterior blocking portion for lockable interaction with said extension portion, wherein said interior blocking portion includes a reinforcement abutment for engaging a side surface of said first frame edge portion corresponding to one of the opposite side surfaces of the second frame edge portion, wherein said reinforcement abutment is movable in relation to said extension portion, and wherein said movable reinforcement abutment is spring-forced in a direction towards said extension portion.

21. A container lock for locking of at least one door of a container, said at least one door having a first frame edge portion, and said container having a second frame edge portion positioned adjacent to said first frame edge portion in a closed position of the at least one door, said container lock comprising:

an interior blocking portion, having a body adapted to extend over said first and second frame edge portions, and an engaging abutment and an extension portion extending out from said body so that, when said interior blocking portion is arranged on an inside of said second frame edge portion, said engaging abutment and extension portion provide interacting engagement of opposite side surfaces of said second frame edge portion, and said extension portion extends from the interior of the container to the exterior of the container, and an exterior blocking portion for lockable interaction with said extension portion, wherein said interior blocking portion includes a reinforcement abutment for engaging a side surface of said first frame edge portion corresponding to one of the opposite side surfaces of the second frame edge portion, wherein said reinforcement abutment is attached to a movable element, which is adapted to be guided by said body, so as to enable movement of said reinforcement abutment in relation to said extension portion, and wherein said movable element further is tiltable in relation to said body, and wherein said movable element and said body are provided with corresponding an engagement device, which are mutually engaged when said movable element is tilted.

* * * * *